US006481537B1

(12) United States Patent
Malone, Jr. et al.

(10) Patent No.: US 6,481,537 B1
(45) Date of Patent: Nov. 19, 2002

(54) ROOFTOP SAFETY APPARATUS FOR ELEVATOR SERVICING

(75) Inventors: Thomas F. Malone, Jr., Avon, CT (US); Robert Isaman, Hong Kong (HK)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/940,118

(22) Filed: Aug. 27, 2001

(51) Int. Cl.[7] ..... B66B 7/00
(52) U.S. Cl. ..... 187/391; 187/401
(58) Field of Search ..... 187/401, 391, 187/276, 277, 294, 414

(56) References Cited

U.S. PATENT DOCUMENTS 787,258 A * 4/1905 Austin ..... 187/391
4,015,689 A * 4/1977 Johnson ..... 187/277
5,773,771 A * 6/1998 Chatham ..... 187/276
6,138,798 A * 10/2000 Macuga ..... 187/294

FOREIGN PATENT DOCUMENTS

JP 02291377 A * 12/1990 ..... B66B/5/00
JP 03067885 A * 3/1991 ..... B66B/9/04
JP 05330752 A * 12/1993 ..... B66B/5/00
JP 08099782 A * 4/1996 ..... B66B/5/00
JP 08198549 A * 8/1996 ..... B66B/7/00

* cited by examiner

*Primary Examiner*—Jonathan Salata

(57) ABSTRACT

Apparatus for protecting a workman mounted upon the roof of a traction elevator car. A vertically disposed sleeve is secured to the roof top area of the car and an elongated column is slidably mounted in the sleeve. A harness is attached near the top of the column by a lanyard.

8 Claims, 2 Drawing Sheets

ROOFTOP SAFETY APPARATUS FOR ELEVATOR SERVICING

FIELD OF THE INVENTION

This invention relates generally to an elevator system, and specifically to apparatus for protecting maintenance personnel working on the roof top of an elevator car.

BACKGROUND OF THE INVENTION

As is well known in the art, much of the maintenance work conducted upon elevators is accomplished by maintenance workers positioned on the roof top of the elevator car. An inspection box containing controls for operating the elevator is mounted on the roof of the car to allow the workers to operate the car at slow speed while on the roof. Because there exists a constant danger that a person working on the roof might fall off the car into the hoist way, maintenance workers are sometimes required to wear safety harnesses while working on the roof of the car in instances where effective car-top guard rails are not available. Each harness is equipped with a lanyard that allows the worker to move freely about the roof top area. These lanyards are relatively long and are typically tethered to the cross head of the lifting frame that extends across the roof of the car at a slightly higher elevation than the roof top. In any event, a good deal of slack is afforded the lanyard which can get in the way of the worker, and will permit the worker to fall some distance before the lanyard catches the worker's fall. Accordingly, there is a need to reduce the slack of the lanyard without restricting the worker's ability to move about. the car roof top area.

SUMMARY OF THE INVENTION

It is therefore an object of the present invention to improve the safety of elevators.

It is a further object of the present invention to better protect maintenance workers while working on the roof top of an elevator car.

These and other objects of the present invention are attained by an apparatus for protecting a worker while performing maintenance work on the roof top of an elevator that is mounted within a hoistway. A beam or column is mounted to the elevator car and preferably is position able to extend vertically a given distance above the car. A body harness worn by the worker can be secured to an elevated section of the beam or column by means of a lanyard which provides sufficient slack to permit the worker to move freely about the roof top, yet is short enough to limit the distance the worker will travel in the event the worker falls off the roof top into the hoist way.

BRIEF DESCRIPTION OF THE DRAWING

For a better understanding of these and other objects and features of the invention, reference will be made to the following detailed description of the invention which is to be read in connection with the accompanying drawing, wherein.

DETAILED DESCRIPTION OF PREFERRED EMBODIMENTS OF THE INVENTION

Figure 1:
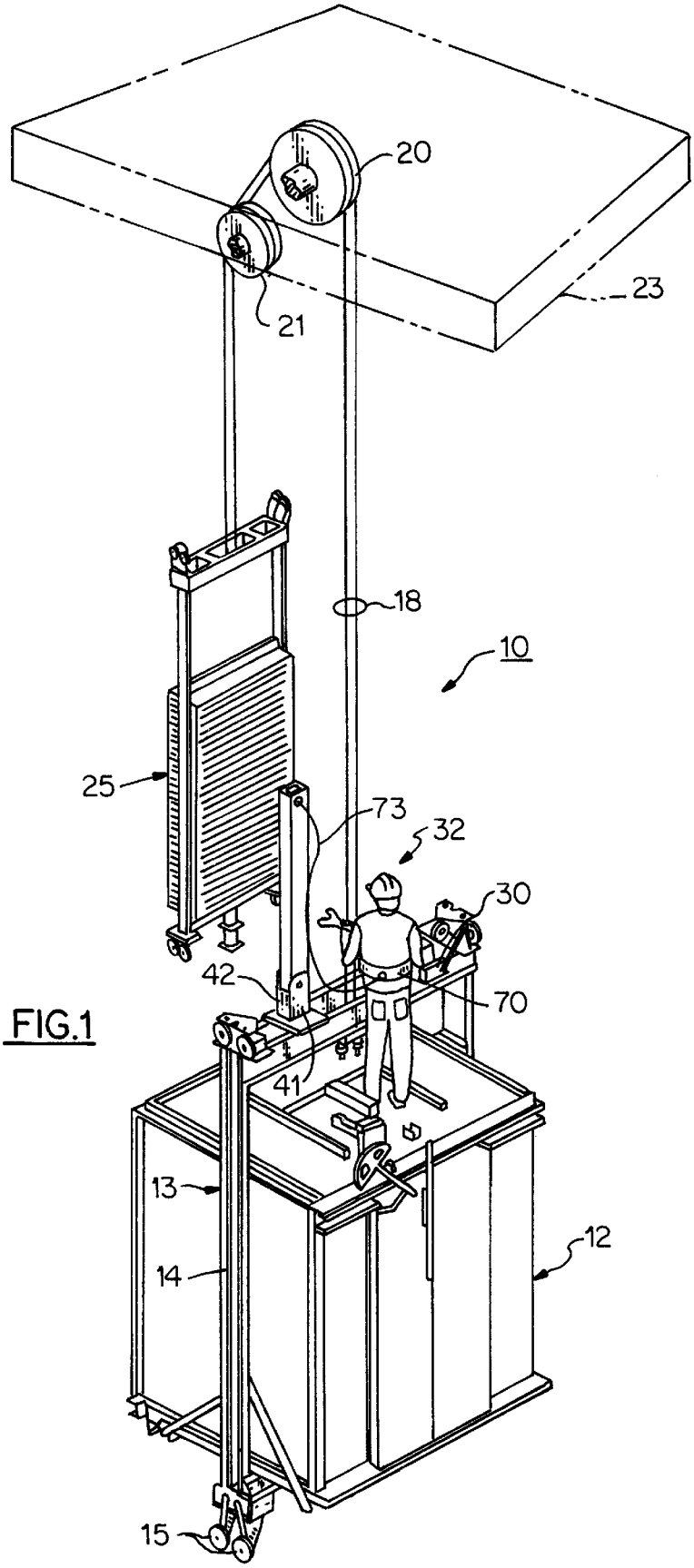
FIG. 1 is a perspective view showing a traction elevator system embodying the teachings of the present invention.

Turning initially to FIG. 1, there is illustrated a traction type elevator system generally referenced 10 that embodies the teachings of a preferred embodiment of the present invention. Although the present invention will be described with specific reference to a traction type elevator system, it should become evident from the disclosure below that the invention can be used in association with any type of elevator system. The system 10 includes an elevator car 12 of well known construction that is supported inside a lifting frame 13. Side members 14 of the frame contain guide mechanisms equipped with rollers 15 that are arranged to ride along opposed guide rails (not shown) that extend vertically along the length of the hoist way.

The lifting frame includes a cross head 17 that passes horizontally across the top of the car between the side members of the frame. Lifting ropes 18 are attached to the cross head and the ropes trained over a drive sheave 20 and a deflection sheave 21, both of which are mounted in the hoist way close to the upper part 23 of the hoistway. The opposite ends of the lifting ropes are secured to a counterweight assembly 25 which, like the car lifting frame, is arranged to ride along vertically disposed guide rails located within the hoistway (not shown). The term lifting rope, as herein used, refers to any suitable flexible cable or belt, as known and used in the art, that is suitable for lifting an elevator within the hoist way.

The motion of the car is obtained through friction between the lifting ropes and the traction drive sheave 20. The lifting ropes are passed over the drive sheave and one end of each rope is secured to the counterweight assembly. Accordingly, the ropes are tension ed on both sides of the drive sheave to develop the necessary drive friction to lift the elevator cab. As can be seen, the counterweight assembly assures that sufficient tension is developed on one side of the sheave. The weight of the car provides the needed opposing tension. An inherent safety feature is that traction is lost in the event the tension differential on the rope exceeds a given limit.

An inspection box 30 is mounted upon the cross head of the lifting frame. The box is connected to the car controller and permits a mechanic 32 situated upon the roof of the car to control the operation of the car from the roof. The inspection box allows the mechanic to move the elevator at very slow speed while he or she inspects the operation of various elevator system components.

Figure 2:
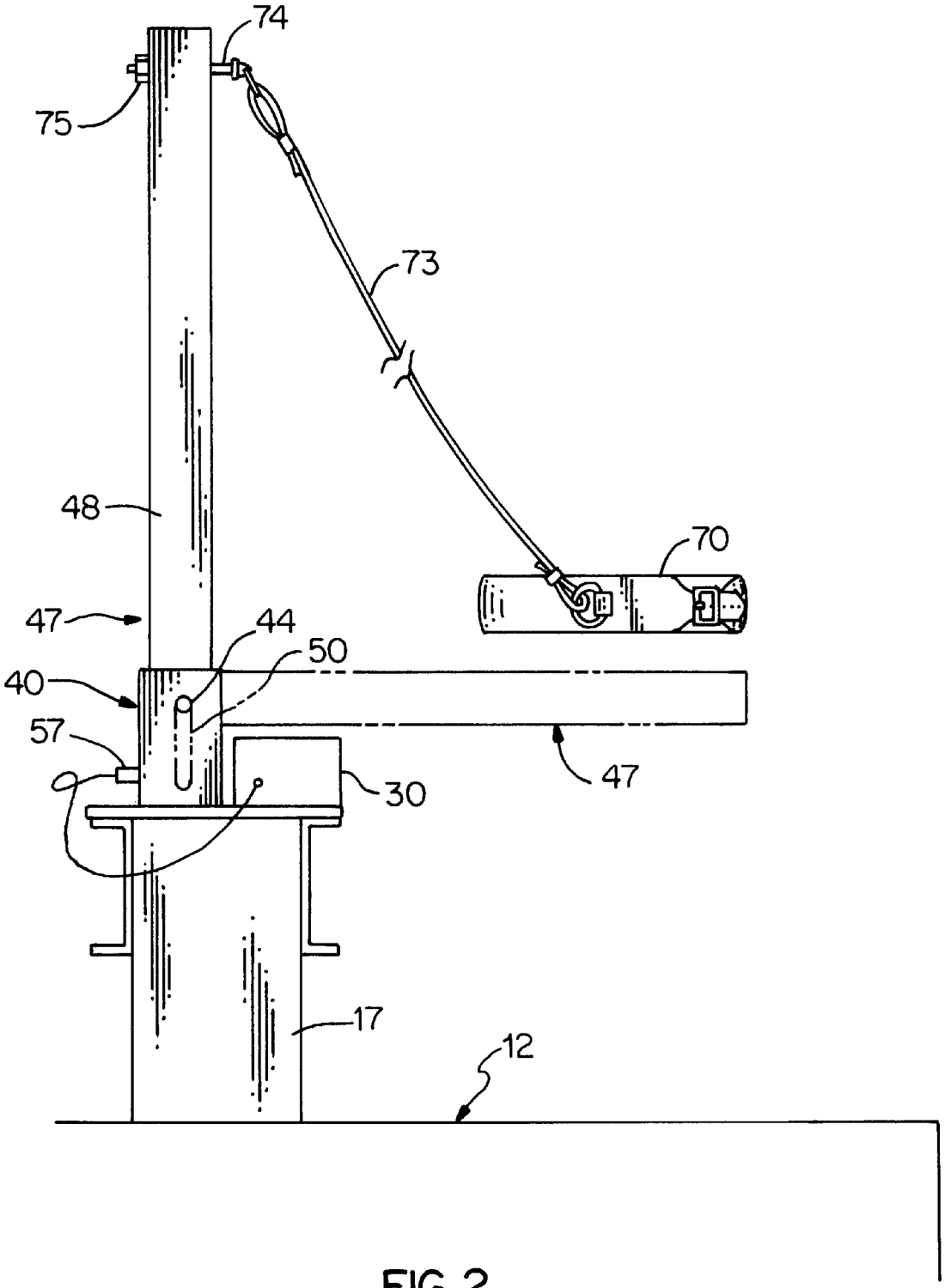
FIG. 2 is a partial enlarged front view illustrating an embodiment of the safety apparatus of the present invention.

With further reference to FIG. 2, the present elevator is provided with a square shaped hollow sleeve 40 that is welded or otherwise connected to the cross head 17 in a vertical or upright position. The sleeve includes a pair of opposed side walls 41 and a pair of opposed end walls 42. As illustrated in FIG. 1, the side walls extend to a higher elevation than the two end walls to establish a cutout in the upper part of the sleeve. A horizontally disposed pivot pin 44 extends across the cutout region and is secured in the upper section of the opposing side wall.

An elongated square shaped hollow column 47 is rotatable mounted upon the pivot pin. In assembly, the pin is arranged to pass through opposed elongated slotted holes 50 formed in the side walls 48 of the column so that the column can rotate between a lowered position as shown in phantom outline in FIG. 2, into an upright position wherein the column is in axial alignment with the sleeve. The column, when placed in a vertical or upright position can be slidably received within the sleeve. The column and the sleeve are sized to provide a close running fit between walls of the column and the walls of the sleeve. The axial length of the slotted holes 50 is sufficiently long to permit the column to bottom within the sleeve. Preferably, the axial length of the column when erected, is about five feet or more so that it extends upwardly to a height that is slightly higher than the shoulder height of an average worker when standing upon the roof of the car. When maintenance is not being performed on the car, the column can be moved out of the way into the lowered position.

Preferably, the column and sleeve assembly should be able to withstand the expected load of a falling worker, and preferably should be sized to comply with regulatory requirements regarding structural strength of fall protection anchorages (for example, current OSHA regulations require sustaining a 5000 lb. static load). The column 47 and sleeve 40 are preferably formed of low-carbon structural steel. Other ferrous alloys. such as other types of steel, or other materials, such as light alloys, polymers and composites, having sufficient strength characteristics, may be used. Further, although the column 47 and sleeve 40 have been shown as rectangular in cross-section, any suitable shapes may be used, so long as the sleeve 40 can maintain the column 47 upright, and the column 47 has sufficient structural strength. For example, the column 47 can be a structural tube or an I-beam without substantially modifying the shape of sleeve 40.

A sensing switch 57 may be mounted to the base of the sleeve where it is cycled by the column as it is bottomed into the sleeve. The switch can be used to disable normal elevator operations when the column is seated, especially if the column could otherwise be lifted into overhead structures during normal operation of the car.

Turning once again to FIG. 2, the column is illustrated in a vertical or upright position seated within the sleeve. A harness 70 of the type worn by a worker operating in high places may be attached to an elevated section of the column by a lanyard 73. An eye bolt 74 is provided at the desired elevation, held securely to the column by a nut 75. The distal end of the lanyard can be coupled to the eye bolt 74. Although a single eye bolt is illustrated in this embodiment of the invention, any suitable connecting device as known and used in the art (such as, for example an eyelet near an edge of the column, or a U-bolt, shackle or clevis) may be employed to attach the lanyard to the upper part of the column. Further, multiple attachment points may be provided to accommodate different height workers. It should be further evident to one skilled in the art that a full body harness may also be employed without departing from the teachings of the invention.

In practice, a column having a length of about five to about six feet is preferably utilized in the practice of the present invention. When erected in the sleeve, the distal end of the lanyard is located at an elevation that is slightly above the average worker's shoulder. The length of the lanyard is such that the lanyard is held aloft allowing the worker to move freely about the roof top of the car while providing little slack in the event the worker falls off the roof into the hoistway.

While the present invention has been particularly shown and described with reference to the preferred mode as illustrated in the drawing, it will be understood by one skilled in the art that various changes in detail may be effected therein without departing from the spirit of the invention as defined by the claims. For example, design variations on the column can include cross-sectional shape (structural tubing, open-section beams, etc.). Further, alternate cross head mounting methods may be used. Alternately, the column may be mounted elsewhere on the lifting frame. Further, other upright brace structures, such as an A-frame or the like, may be employed instead of a vertical column. Although most useful in a low-overhead elevator system, if sufficient overhead space is available in the elevator system, then the column need not be moveable into a lowered position.

We claim:

1. An apparatus for protecting a worker that is harnessed to a lanyard while working upon a roof of an elevator car, comprising:

an upwardly elongated member mounted on the elevator car and extending upwardly above the roof of the car; and a coupling provided on said member for removable attachment of the lanyard to said member.

2. An apparatus for protecting a worker that is harnessed to a lanyard while working upon a roof of an elevator car, comprising:

an upwardly elongated-member mounted on the elevator car and extending upwardly; and a coupling provided on said member for removable attachment of the lanyard to said member, wherein said member is a column that is hinged to move between an upright operative position and a lowered position.

3. The apparatus of claim 2 further including a vertically disposed sleeve secured to the car for slidably receiving said column therein when said column is placed in the upright position.

4. The apparatus of claim 1 wherein said coupling is removably secured to an uppermost section of said member.

5. The apparatus of claim 1 wherein said coupling is located at least approximately five feet above the roof top of the car.

6. The apparatus of claim 2 further comprising a switch for disabling normal elevator operation when the column is in the upright operative position.

7. The apparatus of claim 1 wherein said coupling is located at a height substantially higher than the roof of the car.

8. An apparatus for protecting a worker that is harnessed to a lanyard while working upon a roof of an elevator car, comprising:

an elongated member mounted to the elevator car and extending upwardly; and a coupling provided on said member for removable attachment of the lanyard at a height approximating shoulder height of an average worker standing on the roof of an elevator car.

* * * * *